US006526972B2

(12) United States Patent
Garofalo et al.

(10) Patent No.: US 6,526,972 B2
(45) Date of Patent: Mar. 4, 2003

(54) DEVICE FOR PROVIDING INFORMATION TO A SCUBA DIVER

(75) Inventors: Giovanni Garofalo, Rapallo (IT); Claudio Ferrantino, Camogli (IT)

(73) Assignee: HTM Sport S.p.A. (IT)

( * ) Notice: Subject to any disclaimer, the term of this patent is extended or adjusted under 35 U.S.C. 154(b) by 81 days.

(21) Appl. No.: 09/824,236

(22) Filed: Apr. 3, 2001

(65) Prior Publication Data

US 2001/0027788 A1 Oct. 11, 2001

(30) Foreign Application Priority Data

Apr. 7, 2000 (IT) ..... GE00A0054

(51) Int. Cl.[7] ..... A62B 7/00

(52) U.S. Cl. ..... 128/205.23; 128/201.27; 128/202.22; 128/204.22

(58) Field of Search ..... 128/204.22, 201.27, 128/202.22, 205.23

(56) References Cited

U.S. PATENT DOCUMENTS

| | | | | |
|---|---|---|---|---|
| 4,658,358 A | | 4/1987 | Leach et al. | |
| 5,301,668 A | | 4/1994 | Hales | |
| 5,503,145 A | | 4/1996 | Clough | |
| 5,809,999 A | * | 9/1998 | Lang | 128/200.24 |
| 5,899,204 A | * | 5/1999 | Cochran | 128/205.23 |
| 5,927,274 A | * | 7/1999 | Servido et al. | 128/204.18 |
| 5,937,853 A | * | 8/1999 | Strom | 128/204.23 |
| 5,970,975 A | * | 10/1999 | Estes et al. | 128/204.23 |
| 6,131,572 A | * | 10/2000 | Heionen | 128/205.24 |
| 6,135,106 A | * | 10/2000 | Dirks et al. | 128/204.23 |
| 6,148,816 A | * | 11/2000 | Heionen | 128/205.24 |
| 6,220,242 B1 | * | 4/2001 | Wallin | 128/203.12 |
| 6,253,765 B1 | * | 7/2001 | Hognelid et al. | 128/204.18 |

FOREIGN PATENT DOCUMENTS

| | | |
|---|---|---|
| EP | 0860 354 | 8/1998 |
| FR | 2 454 655 | 11/1980 |
| GB | 1 461 277 | 1/1977 |

* cited by examiner

*Primary Examiner*—Ronald Capossela
(74) *Attorney, Agent, or Firm*—Larson & Taylor, PLC

(57) ABSTRACT

Device for scuba diving consisting of at least a processor and of at least a manometer, both housed within a sheath, said manometer being connected to one or more bottles containing compressed air. The said processor includes a corresponding central unit for data processing, operatively connected to the manometer by means of connecting elements which allow said processor and said manometer to exchange information flows and also to be positioned within the housing sheath independently one from the other, so as to obtain a device for scuba diving with a modular structure.

9 Claims, 1 Drawing Sheet

DEVICE FOR PROVIDING INFORMATION TO A SCUBA DIVER

BACKGROUND OF THE INVENTION

1. Field of the Invention

The present invention relates to information providing devices used by scuba divers during diving sessions.

2. Background of the Invention

As is known, during a diving session with bottles the diver needs to know and check a given amount of data, among which the remaining pressure of the bottles, the remaining air time, the air consumption, the length of the decompression stages and others. To this purpose it is known to provide integrated computers for scuba diving carrying out, by means of suitable sensors, a series of checks on the parameters which are necessary for the calculation and the visualization on a suitable display of said data; for instance said integrated computers are connected by means of a pipe or intake to a pressure sensor placed on the first stage of pressure reduction at the output of the bottles. Said known computers, therefore, combine the functions of a processor provided with a central processing unit or CPU (Control Process Unit) with those of a traditional manometer integrated with said processing unit, at least partially separating the circuits. Said integration between the processing unit and the manometer involves some obvious constructing problems and turns the computer for scuba diving into a highly sophisticated device, extremely expensive to buy and maintain, since the diver has to buy both the processing unit and the manometer, said unit and said manometer being integrated and not to be separated, and moreover, in case the unit or the manometer get damaged, both have to be replaced.

SUMMARY OF THE INVENTION

The present invention, therefore, aims at providing a device for scuba diving which, beyond being versatile and easy to build, allows the scuba diver to buy its constituting elements separately, that is to say either the processor or the manometer, and to mount them onto a single support even at different times, and which also enables, if either element gets damaged, the replacement of said element independently from the other element and from the rest of the computer.

Said aim is achieved by the present invention by means of a device for scuba diving consisting of at least a processing unit and of at least a manometer, both being housed within a sheath, said manometer being connected to one or more bottles containing air under pressure; in said device the processor consists of a corresponding central unit for data processing, which is operatively connected to the manometer by means of connecting elements allowing said processor and said manometer to exchange information flows and also to be positioned within the housing sheath independently one form the other, so as to obtain a device for scuba diving with a modular structure.

Advantageously, therefore, by means of a device for scuba diving carried out with a modular structure according to the present invention, the scuba diver can use a single sheath housing both the processor and the manometer, or either the processor or the manometer, allowing their separate purchase or an independent replacement in case of damage or breakdown.

BRIEF DESCRIPTION OF THE DRAWINGS

Further aims and advantages of the present invention will be better understood in the following description, regarded as a mere non-limiting example, and referring to the enclosed drawings, in which.

DESCRIPTION OF THE PREFERRED EMBODIMENTS OF THE INVENTION

Figures 1, 1A, 2, 2A, 3, 3A:
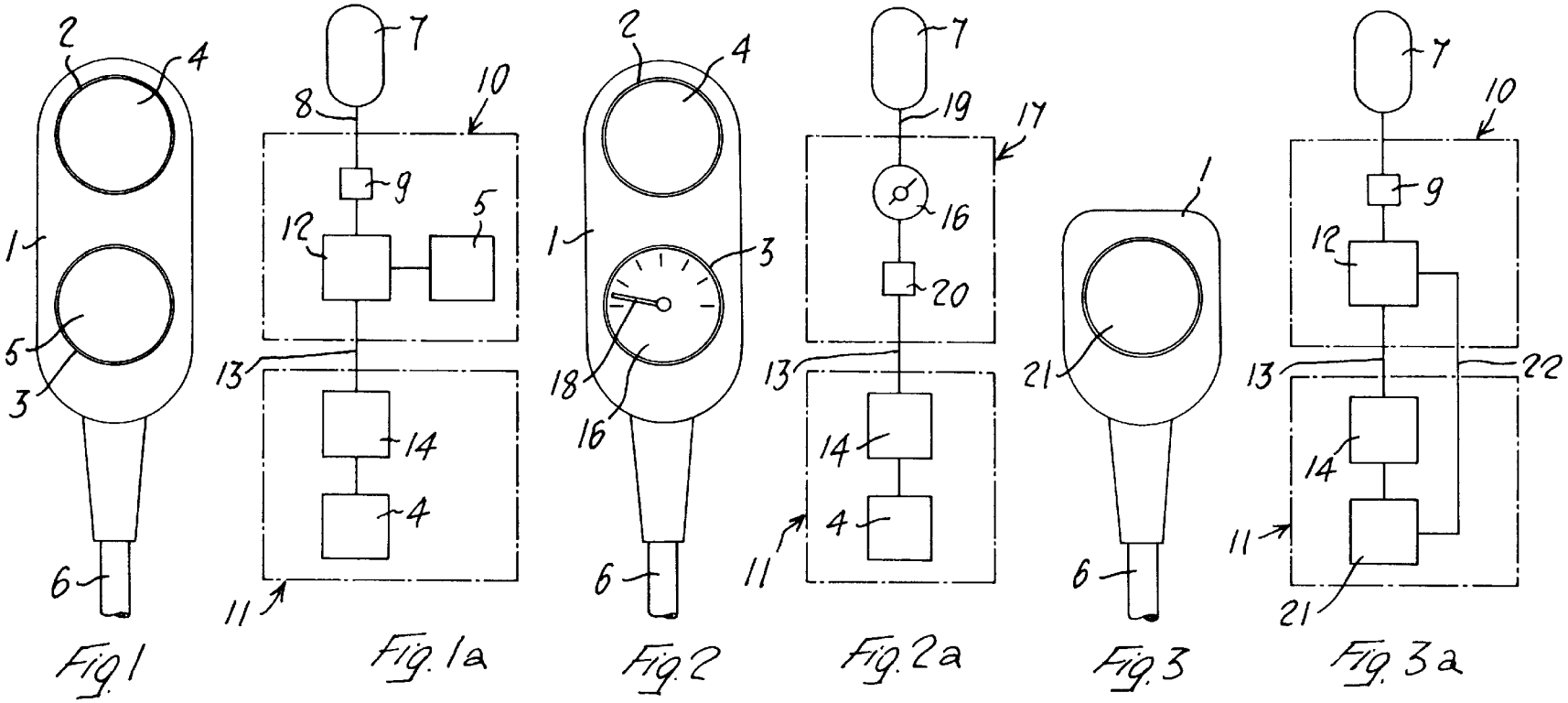
FIG. 1 shows a view of a first form of embodiment of a device for scuba diving according to the present invention.
FIG. 1*a* shows a block diagram referring to the first form of embodiment in FIG. 1 of the device for scuba diving.
FIG. 2 shows a view of a second form of embodiment of the device for scuba diving according to the present invention.
FIG. 2*a* shows a block diagram referring to the second form of embodiment in FIG. 2 of the device.
FIG. 3 shows a view of a third form of embodiment of the device according to the present invention.
FIG. 3*a* shows a block diagram referring to the third form of embodiment in FIG. 3 of the device.

FIG. 1 shows a first form of embodiment of a device for scuba diving according to the present invention. Said device consists of a sheath 1 on the upper surface of which are two sealed housings 2 and 3, said housings being respectively meant for two digital displays 4 and 5: the display 4 belonging to a processor 11 and the display 5 belonging to an electronic manometer 10. An end of a pipe or intake 6 is fixed to the back portion of said sheath 1, the other end being connected to a first reducing stage at the output of a bottle 7, shown in the block diagram in FIG. 1*a*. Said diagram shows the above-mentioned bottle 7 connected by means of a wire 8 introduced into the intake 6 to a transducer 9 turning pressure signals into voltage signals. Said voltage signals are transferred to a central processing unit 12 belonging to the electronic manometer 10, which processes the data received from said transducer 9 and shows them on the display 5, for instance said data can refer to the remaining pressure within the bottle 7. The central unit 12 of the electronic manometer 10 is connected to a central unit 14 for data processing introduced into the processor 11 by means of a connecting element 13, which can be an IR-device communicating with corresponding transmission and reception means provided on the electronic manometer 10 and on the processor 11, a simple electric wire cable, a radio device or others. It is thus possible to carry out a device for scuba diving in which the two main portions it consists of, that is to say, the processor 11 and the electronic manometer 10, are totally separable and autonomous and can be introduced into the sheath 1 at different times; then by means of the above-mentioned connecting element 13 it is possible to establish a continuous data flow between said portions, so that from the display 5 of the electronic manometer 10 it will be possible to select the visualization of a given set of parameters (for instance those referring to the bottle 7), while other parameters can be visualized on the display 4 of the processor 11 (for instance the air time, the air consumption, the decompression stages and others).

FIG. 2 shows a second form of embodiment of the present device for scuba diving. As can be observed, the sheath 1 and the display 4 of the processor 11 are wholly similar to those in the form of embodiment described in FIG. 1. In this variant the electronic manometer 10 has been replaced by a mechanical manometer 17 provided with a sensitive element 19 (FIG. 2*a*) connected on one end to the bottle 7 and on the other end to a pointer 18 rotatably fixed in the center of a dial 16 of said mechanical manometer 17. The deformation of the sensitive element 19 due to a pressure variation in the bottle 7 will be detected by the pointer 18 which will rotate on the dial 16 so as to allow the diver to read said pressure variation. As can be observed from the diagram in FIG. 2*a*, the moving signals of the pointer 18 are turned into voltage signals by a transducer 20 which communicates them to the central unit 14 for data processing of the processor 11 by means of a connecting element 13 previously described. The scuba diver can thus read, as with an ordinary manometer for scuba diving, the remaining pressure of the bottle 7 on the dial 16, and he or she can simultaneously read in real time the remaining air time on the display 4 of the processor 11, which has calculated said air time on the basis of the data received from the mechanical manometer 17. As in the previous form of embodiment, said display 4 can obviously also show other parameters which are useful to the scuba diver during the diving session.

FIGS. 3 and 3*a* show a third form of embodiment of the present computer. As can be observed, a single display 21 is provided on the sheath 1, said display being used by the CPU 12 and the central unit 14 respectively belonging to an electronic manometer 10 and to a processor 11, the latter being wholly similar to those described in FIG. 1*a*. In this case the central processing unit 12 of the electronic manometer 10 is connected by means of a wire 22 to the display 21, on which it will be obviously possible to read all the data requested by the diver, such as bottle pressure, air time and so on. The use of a single display 21, therefore, involves the addition of another connection (the wire 22) between the manometer 10 and the processor 11, which nevertheless does not alter the modular structure of said computer, allowing in any case the diver to separate said processor 11 and manometer 10, and representing, where necessary, an improvement in terms of compactness on the diver's instruments.

We claim:

1. A device for providing information to a scuba diver comprising a processor and a manometer, both mountable within a sheath, said manometer being connected to at least one bottle containing compressed air, the processor including a corresponding central unit for data processing, said processor being operatively connected to the manometer by means of a connecting element which allows the processor and the manometer to exchange information flow and also allows them to be positioned within the housing sheath independently one from the other, such that the manometer and the processor are modular, such that either one or the other or both can be placed within the sheath.

2. A device according to claim 1, wherein the surface of the sheath comprises at least one display for the visualization of the data detected and processed by the said manometer and by the processor.

3. A device according to claim 1, wherein the connecting element comprises at least one optical connecting element.

4. A device according to claim 1, wherein the connecting element comprises wires.

5. A device according to claim 1, wherein the connecting element comprises a wireless connection.

6. A device according to claim 1, wherein the manometer is electronic and comprises a central processing unit for data processing connected to at least one bottle by means of a transducer and connected to a corresponding display for data visualization, said central processing unit of the manometer being connected to the central unit of the processor and the central unit of the processor being connected to a corresponding display for data visualization.

7. A device according to claim 6, wherein the display of the electronic manometer shows data such as the remaining pressure of the bottle, and the display of the processor shows data such as the remaining air time, the air consumption and further information which can be useful to a scuba diver during a diving session.

8. A device according to claim 6, wherein the central processing unit of the electric manometer and the central unit of the processor are connected to a single display for data visualization.

9. A device according to claim 1, wherein the manometer is mechanical and comprises a dial provided with a pointer connected to a sensitive element for detecting the pressure of the bottle, the pressure data detected by the mechanical manometer being transferred to the central unit of the processor by means of a transducer provided within the manometer and being visualized on a display connected to the central unit of the processor.

* * * * *